US007278620B2

(12) United States Patent
Blateri

(10) Patent No.: US 7,278,620 B2
(45) Date of Patent: Oct. 9, 2007

(54) FIXTURE MOUNTING ASSEMBLY

(75) Inventor: Frank Blateri, Coppell, TX (US)

(73) Assignee: Diani, LLC, Dallas, TX (US)

( * ) Notice: Subject to any disclaimer, the term of this patent is extended or adjusted under 35 U.S.C. 154(b) by 172 days.

(21) Appl. No.: 10/865,280

(22) Filed: Jun. 10, 2004

(65) Prior Publication Data

US 2005/0274863 A1 Dec. 15, 2005

(51) Int. Cl.
*B42F 13/00* (2006.01)

(52) U.S. Cl. ..... 248/343; 248/324; 248/317; 248/284.1; 248/291.1; 248/289.11; 248/292.14; 403/61; 403/65; 416/219 R

(58) Field of Classification Search ..... 248/343, 248/323, 324, 317, 284.1, 291.1, 292.14, 248/528, 529, 533; 403/150, 151, 61, 65, 403/100, 102; 211/60.1, 85, 195, 196; 285/23, 285/89, 404, 145.2, 184, 185, 191; 416/219 R
See application file for complete search history.

(56) References Cited

U.S. PATENT DOCUMENTS

| | | | | |
|---|---|---|---|---|
| 5,899,167 | A * | 5/1999 | Furman | 116/173 |
| 6,200,095 | B1 * | 3/2001 | Bucher et al. | 416/5 |
| 6,220,776 | B1 * | 4/2001 | Reeves | 403/102 |
| 6,311,943 | B1 * | 11/2001 | Tang | 248/343 |
| 6,328,270 | B1 * | 12/2001 | Elberbaum | 248/288.31 |
| 6,488,439 | B1 * | 12/2002 | Lackey, Sr. | 403/305 |
| 6,598,846 | B1 * | 7/2003 | Lackey, Jr. | 248/343 |
| 6,644,928 | B1 * | 11/2003 | Tang | 416/246 |
| 6,872,054 | B2 * | 3/2005 | Pearce | 416/244 R |
| 6,981,678 | B2 * | 1/2006 | Fu-Liang | 248/343 |
| 7,100,881 | B2 * | 9/2006 | Worrall | 248/278.1 |
| 2005/0265848 | A1 * | 12/2005 | Tseng | 416/210 R |

* cited by examiner

*Primary Examiner*—Carl D. Friedman
*Assistant Examiner*—Todd M. Epps
(74) *Attorney, Agent, or Firm*—Haynes and Boone, LLP

(57) ABSTRACT

A fixture mounting assembly and method according to which a coupling member is attached to the fixture, and a down-rod is pivotally mounted to the coupling member and is mounted to the ceiling.

1 Claim, 1 Drawing Sheet

FIXTURE MOUNTING ASSEMBLY

BACKGROUND

The present invention relates to an assembly and method for mounting a fixture, such as a ceiling fan or light, in a spaced relation to a ceiling.

Various ceiling-mountable fixtures, such as fans, lights (semiflushes, chandeliers, pedants, etc,), loudspeakers, monitors, video cameras, televisions, and the like, are usually connected to an electrical box, terminal, or the like, at the ceiling. When it is desired to mount the fixture in a spaced relation to the ceiling, a down-rod is often connected between the electrical box, or terminal, and the fixture. Normally an installer has to attach the down-rod to the fixture, fish electrical conductors from the fixture through the down-rod, and attach the down-rod to the ceiling. This is labor intensive and adds to the cost of the fixture.

Therefore what is needed is an installation assembly and method that facilitates the above installation and reduces the installation time.

DESCRIPTION OF THE PREFERRED EMBODIMENT

Figure 1:
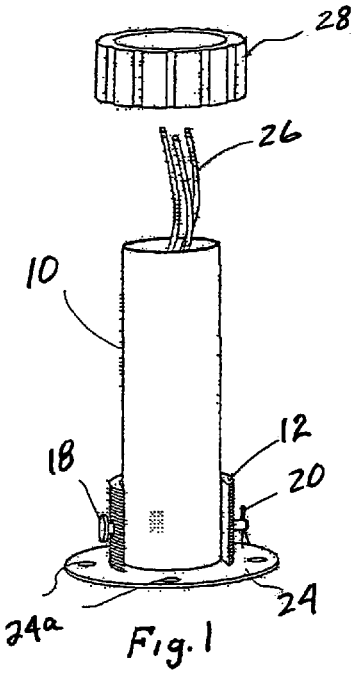
FIGS. 1-3 are enlarged isometric views of an assembly according to an embodiment of the invention, depicted in different operational modes.

Referring to FIG. 1 of the drawings, the reference 10 refers, in general, to a down-rod that is designed to connect a fixture (not shown), such as a ceiling fan, light, or the like, in a spaced relation to a ceiling. To this end, the upper end portion of the down-rod 10, as viewed in FIG. 1, would be connected to a conventional electrical box terminal, or the like, (not shown), mounted in the ceiling.

The lower end portion of the down-rod 10 is pivotally mounted to an externally threaded coupling member 12 having a semi-annular cross section. To effect this pivotal movement, a pivot bolt 18 extends through aligned openings formed through the coupling member 12 and the down-rod 10, and a locking pin 20 is attached to an end portion of the bolt. The diameters of the above openings are larger than the diameter of the bolt 18 to permit pivotal movement of the down-rod 10 relative to the coupling member between a substantially vertical position shown in FIGS. 1 and 2 to a substantially horizontal position shown in FIG. 3.

The lower end of the coupling member 12 is attached, in any conventional manner, to a mounting plate 24 having a series of angularly-spaced openings 24*a* formed through the plate. The mounting plate 24 is adapted for attachment to a fixture (not shown) that is to be mounted, in a spaced relation, to the ceiling. For example, if the fixture were a ceiling fan, the mounting plate could be attached to the motor housing of the fan by inserting screws, bolts, or the like (not shown) through the openings 12*a* and into corresponding openings in the housing, in a conventional manner.

Figure 2:
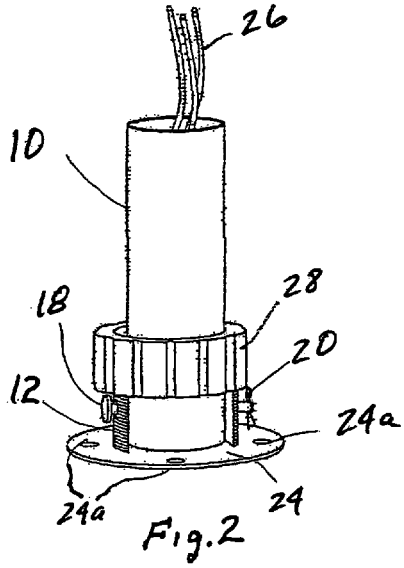

A plurality (three in the example shown in the drawings) of electrical conductors 26 extend from the above-mentioned fixture, through a central opening (not shown) in the plate 24, and up through the interior of the down-rod 10, with the free end portions of the electrical conductors extending out a few inches from the upper end of the down-rod as shown in FIGS. 1 and 2. It is understood that the electrical conductors 26 can be connected to appropriate terminals or electrical conductors provided in the electrical box in the ceiling that extend from an electrical power source so that the fixture is electrically powered.

As shown in FIG. 2, an internally threaded nut 28 is provided that is adapted to threadedly engage the upper portion of the externally threaded coupling member 12 to secure the down-rod 10 in the vertical position shown in FIGS. 1 and 2. In this position, when the upper end portion of the down-rod 10 is connected to the ceiling in the manner discussed above, and the mounting plate 24 is connected to the fixture, the fixture is mounted in a spaced relation to the ceiling.

Figure 3:
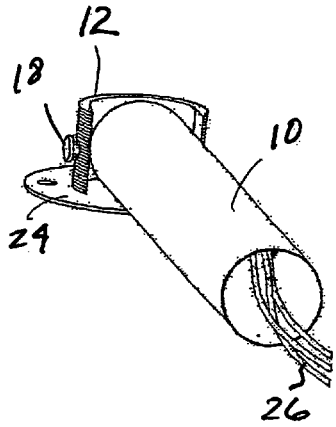

In order to enable the assembly shown in FIGS. 2 and 3 to be easily packed and shipped, the nut 28 can be removed (and packed separately) and the down-rod 10 pivoted to a substantially horizontal position shown in FIG. 3. (The pin 20 could be removed from the bolt 18 and the bolt removed from the coupling 12 and the down-rod 10 removed from the coupling 12, if necessary).

To mount the fixture to the ceiling, the down-rod 10 is simply pivoted to its substantially vertical position shown in FIGS. 1 and 2, and the nut 28 is then threadedly engaged over the coupling 12. The electrical conductors 26 from the fixture can then be threaded through the mounting plate 24 and the down-rod 10 and connected to the above-mentioned terminals or conductors in the ceiling. The down-rod 10 then can be connected to the ceiling. Alternatively, the electrical conductors 26 from the electrical box, terminal, or the like at the ceiling can be threaded through the down-rod 10 and the mounting plate 24, and connected to terminals or conductors in the fixture, after which the down-rod 10 is connected to the ceiling.

The assembly of the present invention thus enables the fixture 10 to be easily and quickly mounted to the ceiling while taking up relatively little extra space when packing and shipping.

It is understood that variations may be made in the foregoing without departing from the scope of the invention. For example, the mounting plate 24 can be connected to the fixture in any conventional manner other than that disclosed above, or it can be formed integrally with the fixture. Also, the mounting plate 24 can be eliminated and the coupling member can be connected directly to the fixture. Further, the shape of the coupling member 12 and the mounting plate 24 can be varied. Moreover, the manner of pivotally connecting the down-rod 10 to the coupling member 12 can be varied. Still further, the spatial references, such as "upper", "lower", "downwardly", etc., are for the purpose of illustration only and do not limit the spatial orientation or location of the structure described.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. An assembly for mounting a fixture to a ceiling, the assembly comprising:

a mounting plate adapted to be connected to the upper surface of the fixture or to form a portion of the fixture;

a cylindrical coupling member mounted on the plate and having a slot formed therein;

a plurality of threads provided on the outer surface of the coupling member;

two diametrically-opposed through openings formed through the wall of the coupling member;

a down-rod adapted to extend substantially vertically with its lower end portion extending in the coupling member in a coaxial relationship;

the lower end portion of the down-rod engaging the upper surface of the plate, and the upper end portion of the down-rod adapted to be connected to the ceiling;

two diametrically-opposed through openings formed through the wall of the down-rod and adapted to be aligned with the openings in the coupling member;

a bolt extending through the aligned openings to pivotably mount the down-rod to the coupling member for movement between the substantially vertical position and a substantially horizontal position in which the down-rod radially extends throught the slot, wherein the slot is sized to allow the down-rod to radially extend through the arcuate slot when the down-rod is in the substantially horizontal position; and an internally threaded retaining member adapted to extend around the down-rod when it is in the substantially vertical position and to engage the threads on the coupling member to retain the down-rod in the substantially vertical position.

* * * * *